US009803663B2

(12) United States Patent
VanderVeen et al.

(10) Patent No.: US 9,803,663 B2
(45) Date of Patent: Oct. 31, 2017

(54) TELESCOPING FLUID PORTING TUBE

(71) Applicant: Parker-Hannifin Corporation, Cleveland, OH (US)

(72) Inventors: John Scott VanderVeen, Galesburg, MI (US); Julian Douglas Voss, Kalamazoo, MI (US)

(73) Assignee: PARKER-HANNIFIN CORPORATION, Cleveland, OH (US)

( * ) Notice: Subject to any disclaimer, the term of this patent is extended or adjusted under 35 U.S.C. 154(b) by 639 days.

(21) Appl. No.: 14/354,799

(22) PCT Filed: Oct. 26, 2012

(86) PCT No.: PCT/US2012/062066
§ 371 (c)(1),
(2) Date: Apr. 28, 2014

(87) PCT Pub. No.: WO2013/063362
PCT Pub. Date: May 2, 2013

(65) Prior Publication Data

US 2014/0305299 A1 Oct. 16, 2014

Related U.S. Application Data

(60) Provisional application No. 61/552,352, filed on Oct. 27, 2011, provisional application No. 61/555,517, filed on Nov. 4, 2011.

(51) Int. Cl.
*F15B 13/02* (2006.01)
*F15B 15/14* (2006.01)
*F15B 11/08* (2006.01)

(52) U.S. Cl.
CPC ..... *F15B 15/149* (2013.01); *F15B 11/08* (2013.01); *F15B 2211/3058* (2013.01);
(Continued)

(58) Field of Classification Search
CPC ..... F02K 1/68; F02K 1/70; F02K 1/72; F02K 1/12; F15B 11/22; F15B 15/149
See application file for complete search history.

(56) References Cited

U.S. PATENT DOCUMENTS 3,256,781 A 6/1966 Daniels
3,296,936 A 1/1967 Weiss et al.
(Continued)

FOREIGN PATENT DOCUMENTS

EP 0 924 158 A1 6/1999
WO 2009/029401 3/2009

OTHER PUBLICATIONS

International Search Report and Written Opinion corresponding to International Application No. PCT/US2012/062066 dated Jan. 31, 2013.

(Continued)

*Primary Examiner* — Edelmira Bosques
*Assistant Examiner* — Richard Drake
(74) *Attorney, Agent, or Firm* — Renner, Otto, Boisselle & Sklar, LLP.

(57) ABSTRACT

Provided is an electro-hydraulic control system (10) for controlling the movement of a third structure (18) of an engine using a power actuator (26) mountable to the third structure (18), a telescoping fluid porting tube (24) for porting a fluid to the power actuator (26) and a control valve (22) for controlling the flow of movement to effect the movement of the third structure (18). In this way, the third structure (18), such as a nozzle slat of an engine, may be moved via a compact and lightweight electro-hydraulic system.

13 Claims, 12 Drawing Sheets

(52) U.S. Cl.
CPC ... *F15B 2211/60* (2013.01); *F15B 2211/7107* (2013.01); *F15B 2211/8752* (2013.01)

(56) References Cited

U.S. PATENT DOCUMENTS

| | | | | |
|---|---|---|---|---|
| 3,318,199 | A | 5/1967 | Parrett | |
| 3,525,212 | A | 8/1970 | Gallant | |
| 3,814,324 | A * | 6/1974 | Wanger | F02K 1/12 239/127.3 |
| 3,858,488 | A | 1/1975 | Newstead et al. | |
| 4,391,409 | A * | 7/1983 | Scholz | F02K 1/763 239/265.29 |
| 4,409,884 | A * | 10/1983 | Boehringer | F15B 11/22 91/171 |
| 5,007,327 | A | 4/1991 | Kamimura et al. | |
| 5,011,195 | A | 4/1991 | Nightingale | |
| 5,350,054 | A * | 9/1994 | Foster | B65G 25/065 198/750.5 |
| 5,636,616 | A | 6/1997 | Okane et al. | |
| 5,638,616 | A * | 6/1997 | Kishi | E02F 3/306 37/186 |
| 5,806,302 | A * | 9/1998 | Cariola | F02K 1/09 239/265.29 |
| 6,439,512 | B1 | 8/2002 | Hart | |
| 8,511,062 | B2 * | 8/2013 | Ramlaoui | F02K 1/09 239/265.27 |
| 2008/0246421 | A1 | 10/2008 | Harvey et al. | |
| 2009/0013664 | A1 | 1/2009 | Jones et al. | |
| 2009/0288386 | A1 | 11/2009 | Marshall et al. | |
| 2011/0120078 | A1 | 5/2011 | Schwark, Jr. et al. | |
| 2011/0120080 | A1 | 5/2011 | Schwark, Jr. et al. | |
| 2011/0256000 | A1 * | 10/2011 | Fukui | F04B 49/002 417/213 |

OTHER PUBLICATIONS

Second International Written Opinion corresponding to International Application No. PCT/US2012/062066 dated Nov. 25, 2013.
IPRP corresponding to International Application No. PCT/US2012/062066 dated Feb. 14, 2014.

* cited by examiner

TELESCOPING FLUID PORTING TUBE

RELATED APPLICATIONS

This application is a national phase of International Application No. PCT/US2012/062066 filed Oct. 26, 2012 and published in the English language, which claims the benefit of U.S. Provisional Application No. 61/552,179 filed Oct. 27, 2011, and U.S. Provisional Application No. 61/555,517 filed Nov. 4, 2011, which are all hereby incorporated herein by reference.

FIELD OF INVENTION

The present invention relates generally to electro-hydraulic control systems, and more particularly to an electro-hydraulic control system of an engine having a telescoping fluid porting tube for porting fluid for controlling the movement of an engine structure.

BACKGROUND

An aircraft turbine engine includes an engine structure and at least one secondary structure, such as a variable area fan nozzle (VAFN) structure moveable relative to the engine structure. The VAFN structure develops a portion of the thrust provided by the engine by controlling a portion of the airflow through fan portions of the engine. The VAFN structure may be movable to different positions for aircraft take-off, landing, cruise, etc. Hydraulic control systems and electronic control systems may be used for controlling movement of the secondary structure relative to the engine structure.

SUMMARY OF INVENTION

The present invention provides an electro-hydraulic control system for controlling the movement of a third structure of an engine using a power actuator mountable to the third structure, a telescoping fluid porting tube for porting a fluid to the power actuator and a control valve for controlling the flow of movement to effect the movement of the third structure. In this way, the third structure, such as a nozzle slat of an engine, may be moved via a compact and light-weight electro-hydraulic system.

According to one aspect of the invention, an electro-hydraulic control system is provided that includes a power actuator mountable between the second structure and the third structure for moving the third structure, a telescoping fluid porting tube mountable between the first structure and the second structure for porting a fluid to the power actuator, and a control valve for controlling flow of the fluid through the telescoping fluid porting tube to the power actuator for effecting movement of the third structure relative to the second structure.

The telescoping fluid porting tube may include an outer tubular body having a closed end for mounting to one of the second structure or the third structure, an open end, and a tubular wall defining a chamber, a piston axially disposed in and axially translatable within the chamber, and a telescopically movable piston rod having a first end connected to the piston and a second end mountable to the other of the second structure or the third structure, the piston rod extending at least partially through the open end of the outer tubular body and being radially inwardly spaced from the tubular wall, wherein the piston rod includes a fluid passageway extending along a length thereof in fluidic communication with the chamber for transferring fluid along a length of the piston rod.

The outer tubular body of the telescoping fluid porting tube may include a port fluidically coupled to the control valve for receiving fluid therefrom.

The port may extend through the tubular wall.

The port may be adjacent to the open end of the outer tubular body.

The telescoping fluid porting tube may further include the piston sealed to an inner portion of the tubular wall to prevent fluidic communication between the closed end and the fluid passageway when the piston is axially translated.

The piston rod may include at least one opening at the first end extending through a wall of the piston rod for fluidically coupling the chamber to the fluid passageway.

The telescoping fluid porting tube may be mountable to at least one of the first structure or the second structure via a gimballing mount.

The electro-hydraulic control system may also include first and second telescoping fluid porting tubes mountable between the first structure and the second structure.

The electro-hydraulic control system may also include a pair of telescoping fluid porting tubes, wherein a first telescoping fluid porting tube has a first fluid path extending between the control valve and the power actuator for porting fluid for effecting movement of the third structure away from the first structure, and wherein a second telescoping fluid porting tube has a second fluid path extending between the control valve and the power actuator for porting fluid for effecting movement of the third structure towards the first structure.

The first and second telescoping fluid porting tubes may be parallel to one another.

The electro-hydraulic control system may further include a pair of power actuators for effecting movement of the third structure relative to at least one of the first structure or the second structure.

The control valve may include at least one of an electro-hydraulic servo-valve and/or a bypass valve.

The electro-hydraulic control system may also include a control system for regulating a fluid pressure at the power actuator, the control system communicatively connected to both the control valve and to a feedback apparatus mountable to the third structure or locatable to contact the third structure.

The feedback apparatus may include a linear variable differential transformer.

According to another aspect of the invention, a telescoping fluid porting tube is provided for porting fluid between moveable structures of an engine. The telescoping fluid porting tube may include an outer tubular body having a closed end, an open end, and a tubular wall defining a chamber, a piston axially disposed in and axially translatable within the chamber, and a telescopically movable piston rod connected to the piston for movement therewith, the piston rod being radially inwardly spaced from the tubular wall and extending at least partially through the open end of the outer tubular body, wherein the piston rod includes a fluid passageway in fluidic communication with the chamber for transferring fluid along a length of the piston rod.

The outer tubular body may have a port fluidically coupled to the control valve for receiving fluid therefrom.

The port may extend through the tubular wall.

The piston may be sealed to an inner portion of the tubular wall to prevent fluidic communication between the closed end and the fluid passageway when the piston is axially translated.

The piston rod may include at least one opening at the first end extending through a wall of the piston rod for fluidically coupling the chamber to the fluid passageway.

According to yet another aspect, an electro-hydraulic control system is provided for controlling the movement of a third structure of an engine, the electro-hydraulic control system including a power actuator for moving the third structure, a control valve for controlling flow of a fluid to the power actuator for effecting movement of the third structure relative to a first structure, and a telescoping fluid porting tube fluidically interposed between the control valve and the power actuator for porting fluid from the control valve to the power actuator, wherein the telescoping fluid porting tube includes, an outer tubular member having a first port for fluidically communicating with the control valve, and a telescopically moveable piston rod at least partially disposed within the outer tubular member, the piston rod having a fluid passageway for transporting fluid along a length thereof to an outlet of the piston rod for fluidically communicating with the power actuator.

According to a further aspect, a method may be provided for selectively extending and retracting a third structure of an engine including a first structure, a second structure, and the third structure, the method including the steps of receiving feedback from a feedback apparatus mounted to at least one of the first structure, the second structure, or the third structure, sending a response to a control valve communicatively connected to the feedback apparatus, regulating via the control valve a flow of a fluid from the control valve through a telescoping fluid porting tube mounted between the first structure and the second structure, and directing the fluid from the telescoping fluid porting tube to a power actuator mounted to the third structure.

According to another aspect, an engine may be provided including a mechanical assembly including a first structure, a second structure, and a third structure, and an electro-hydraulic control system including a power actuator mountable between the second structure and the third structure, the power actuator for moving the third structure, a telescoping fluid porting tube mountable between the first structure and the second structure for porting a fluid to the power actuator, and a control valve for controlling flow of the fluid through the telescoping fluid porting tube to the power actuator for effecting movement of the third structure.

The foregoing and other features of the invention are hereinafter described in greater detail with reference to the accompanying drawings.

DETAILED DESCRIPTION

The principles of the present invention have particular application to electro-hydraulic systems on aircrafts and thus will be described below chiefly in this context. It will of course be appreciated, and also understood, that the principles of the invention may be useful in other applications including, in particular, other vehicles having electro-hydraulic systems, such as construction equipment and tanks.

Figure 1:
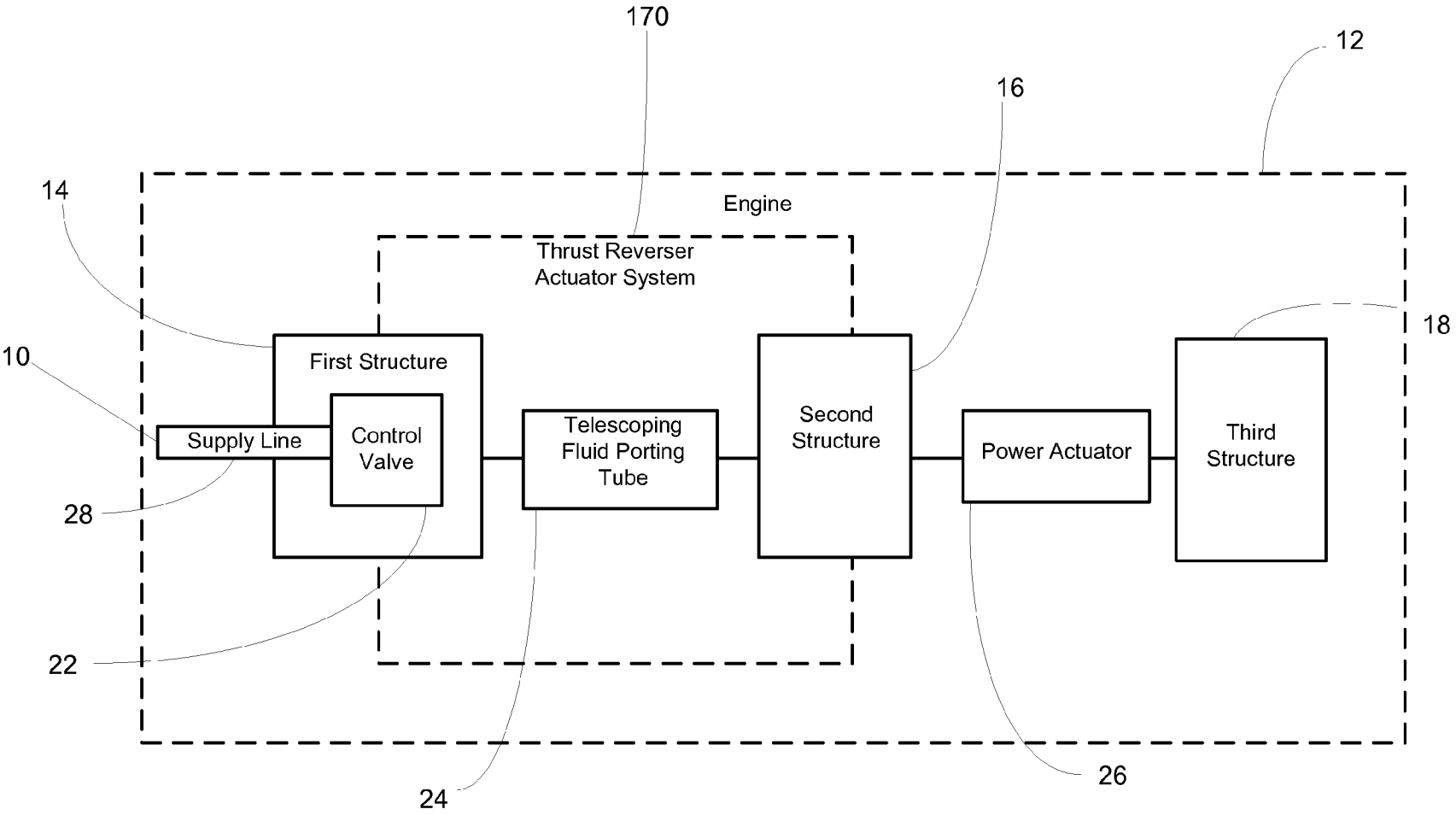
FIG. 1 is a schematic view of an engine having an exemplary electro-hydraulic control system according to the invention.

Referring now in detail to the drawings and initially to FIG. 1, an electro-hydraulic control system 10 is provided in an engine 12, which may be any suitable engine, such as a turbine engine. The engine 12 includes a first structure, such as an engine base structure 14, a second structure, such as a translating cowling (herein "transcowl") 16, and a third structure, such as a variable area fan nozzle structure (herein "VAFN structure") 18. The VAFN structure 18 may be any suitable structure for controlling a portion of the thrust of air flow provided by the engine 12, such as a slat, a partial cowling, etc.

The electro-hydraulic system includes a telescoping fluid porting tube 24 mountable between the engine base structure 14 and the transcowl 16, a power actuator, such as a VAFN actuator 26 mountable between the transcowl 16 and the VAFN structure 18, a control valve 22 for controlling flow of fluid through the telescoping fluid porting tube 24 to the VAFN actuator 26, and supply lines 28. The telescoping fluid porting tube 24 and the VAFN actuator 26 may be mounted to the engine base structure 14, transcowl 16 and VAFN structure 18 in any suitable manner.

The control valve 22 may be mounted to the engine in any suitable location, such as to one of the engine base structure 14, the transcowl 16, or the VAFN structure 18. The control valve 22 may alternatively be mounted to the engine in any suitable static location, such as to the engine base structure 14. The supply line 28 is provided to deliver a fluid, such as a hydraulic fluid, to the electro-hydraulic control system 10, and more particularly to the control valve 22. The control valve 22 may controllably direct flow of the fluid through the telescoping fluid porting tube 24 to the VAFN actuator 26 for effecting movement of the VAFN structure 18 relative to at least one of the engine base structure 14 or the transcowl 16. The VAFN structure 18 may be moved via a compact and lightweight electro-hydraulic system. It will be appreciated that such an electro-hydraulic system may avoid the use of an electro-mechanical system.

Figure 2:
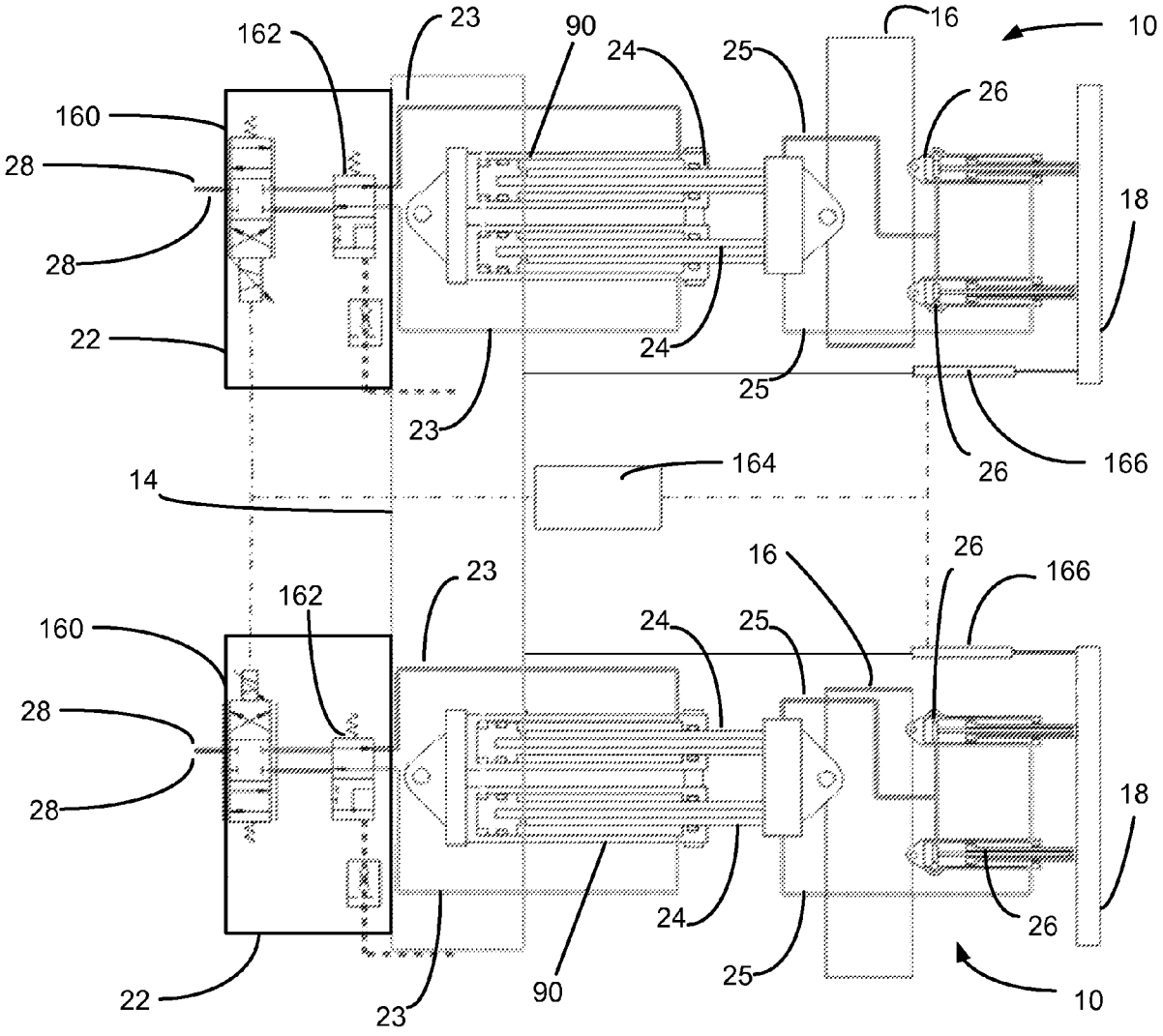
FIG. 2 is a schematic view of the exemplary electro-hydraulic control system according to the invention.
Figure 3:
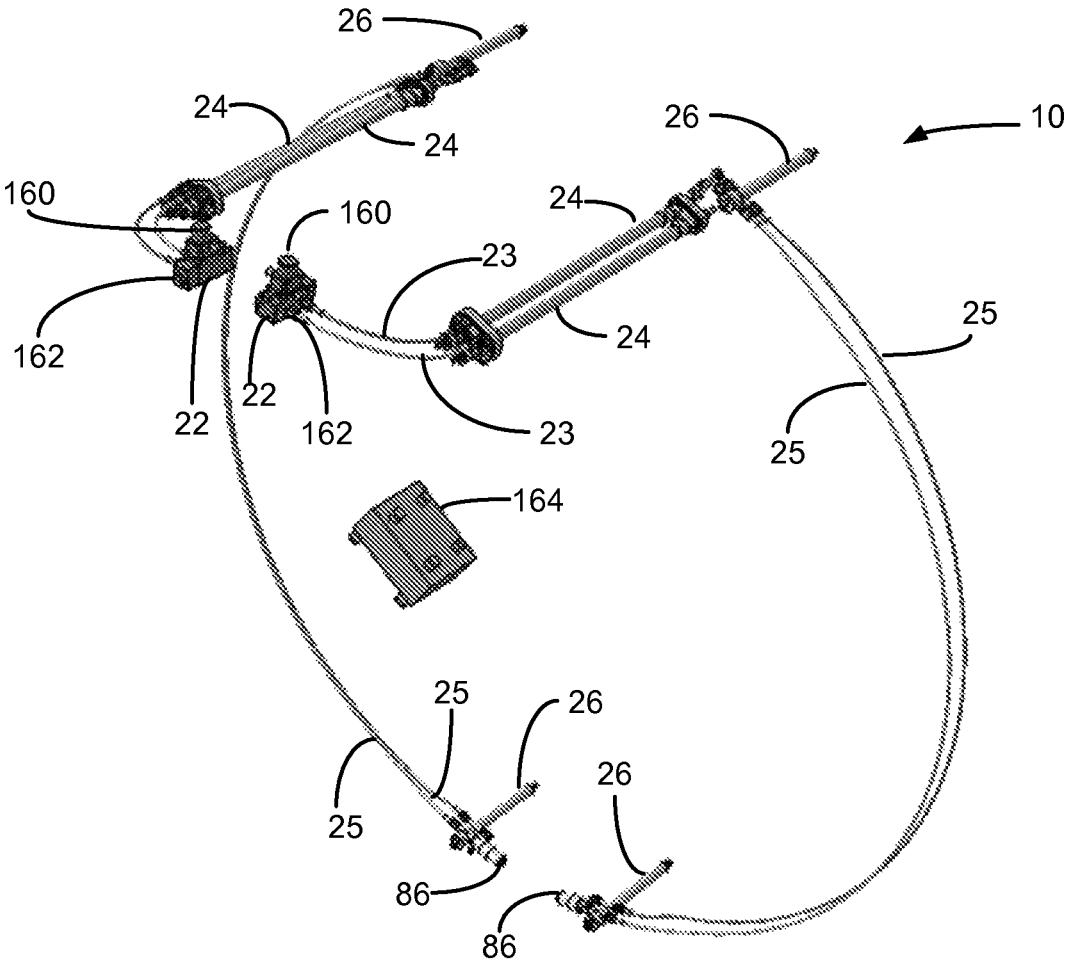
FIG. 3 is a perspective view of the exemplary electro-hydraulic control system of FIGS. 1 and 2.

Turning now to FIGS. 2 and 3, two electro-hydraulic control systems 10 are illustrated, one control system serving as a left electro-hydraulic control system and one control system serving as a right electro-hydraulic control system. The left and right electro-hydraulic control systems are substantially the same, and thus only one control system will be described below in detail.

Each electro-hydraulic control system 10 includes a pair of telescoping fluid porting tubes 24, a pair of VAFN actuators 26 mounted to any of the engine base structure 14, transcowl 16, and/or VAFN structure 18, in any suitable manner. It will be appreciated, however, that any suitable number of telescoping fluid porting tubes 24 and VAFN actuators 26 may be provided. Each of the telescoping fluid porting tubes 24 is fluidically coupled to the control valve 22 in any suitable manner, such as by a suitable tube 23, which delivers a suitable fluid to a port 124 (FIG. 8) of the fluid porting tube 24. Similarly, each of the telescoping fluid porting tubes 24 is fluidically coupled to a respective one of the VAFN actuators in any suitable manner, such as by a suitable tube 25.

Figure 4:
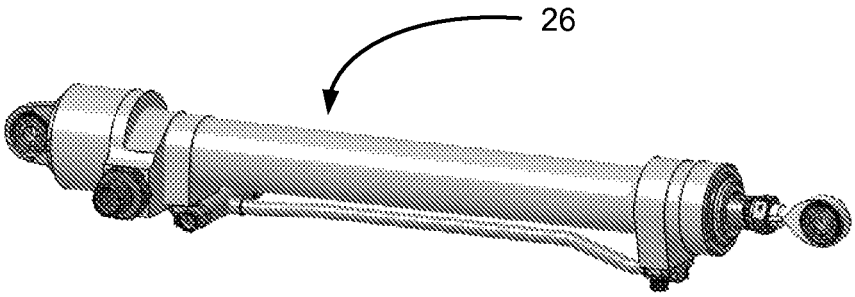
FIG. 4 is a perspective view of a power actuator of the electro-hydraulic control system.
Figure 5:
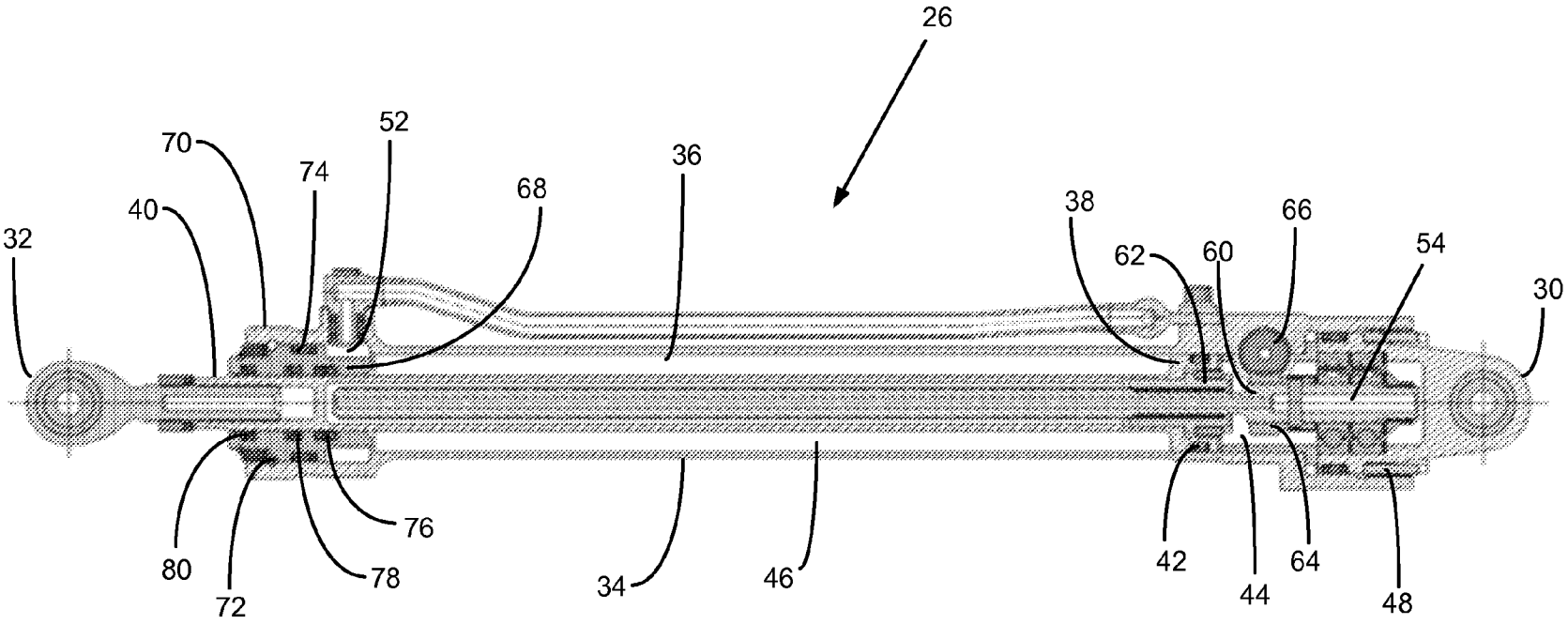
FIG. 5 is a cross-sectional view of the power actuator of FIG. 4.
Figure 6:
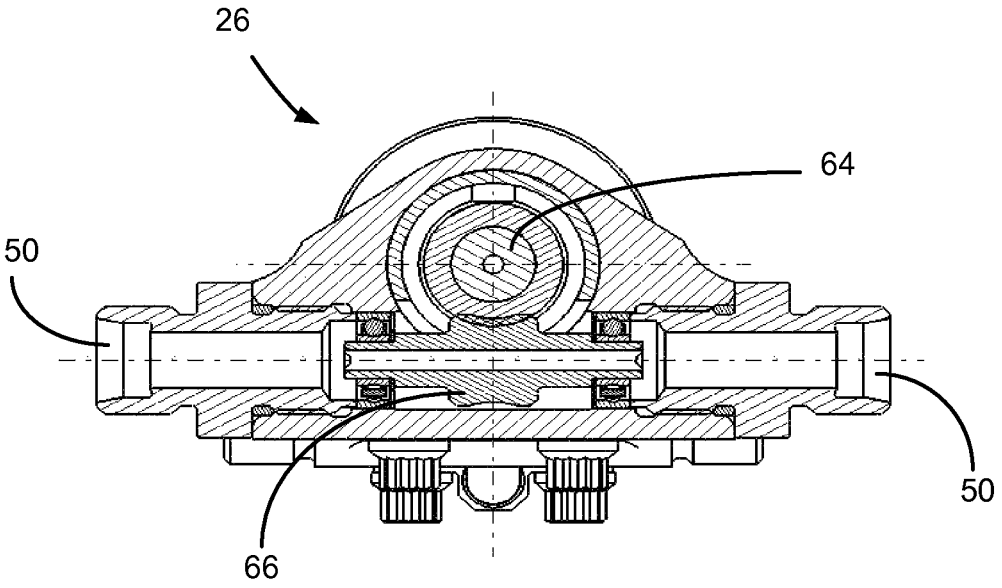
FIG. 6 is a cross-sectional view of an end of the power actuator of FIG. 4

Turning now to FIGS. 4-6, the VAFN actuator 26 includes a head end 30 for mounting to the transcowl 16 and a rod end 32 for mounting to the VAFN structure 18. Alternatively, it will be appreciated that the head end 30 may be mountable to the VAFN structure 18 and the rod end 32 may be mountable to the transcowl 16. The VAFN actuator 26 also includes an outer body 34 defining a piston chamber 36 for receiving a piston 38 and a piston rod 40 of the VAFN actuator. The piston 38 seals to an inner wall of the outer body 34 using a suitable seal such as o-ring 42, to separate the piston chamber 36 into an extend chamber 44 and a retract chamber 46, and the head end 30 is retained in the outer body 34 by a suitable retainer, such as a threaded retainer 48. The extend chamber 44 receives fluid through an extend port 50 for effecting extension of the VAFN structure 18, and the retract chamber 46 receives fluid through a retract port 52 for effecting retraction of the VAFN structure 18.

At least one of the pair of VAFN actuators 26 may include a gear system 54 adjacent the head end 30 for mechanically synchronizing the VAFN actuator 26 with the other VAFN actuator 26, thus synchronizing movement of a VAFN structure 18. The gear system 54 includes an acme screw 60, an acme nut 62 surrounding the acme screw 60, a worm gear 64 engaging the acme screw 60 and a worm shaft 66, and a flex cable (not shown) connected to the worm shaft 66 of each of the pair of VAFN actuators 26. At the rod end 32, the VAFN actuator 26 includes an end gland 68 closing an end 70 of the outer body 34 and retained by a retainer ring 72. The end gland 68 is sealed to an inner wall of the outer body 34 by a suitable seal, such as o-ring 74, and the end gland 68 is sealed to an outer wall of the piston rod 40 by suitable seals, such as o-rings 76, 78 and annular scraper 80.

At least one of the VAFN actuators 26 may also include a manual drive unit 86 (FIG. 3) for mechanically coupling to the gear system 54 of the VAFN actuator 26. The manual drive unit 86 may be included in a lower VAFN actuator 26 for ease of access and may enable manual control of at least one VAFN actuators 26, thereby effecting manual movement of the VAFN structure 18. In the case of a malfunctioning VAFN actuator 26 of an aircraft, the VAFN structure 18 may be positioned to an open position required for takeoff and landing of the aircraft.

Figure 7:
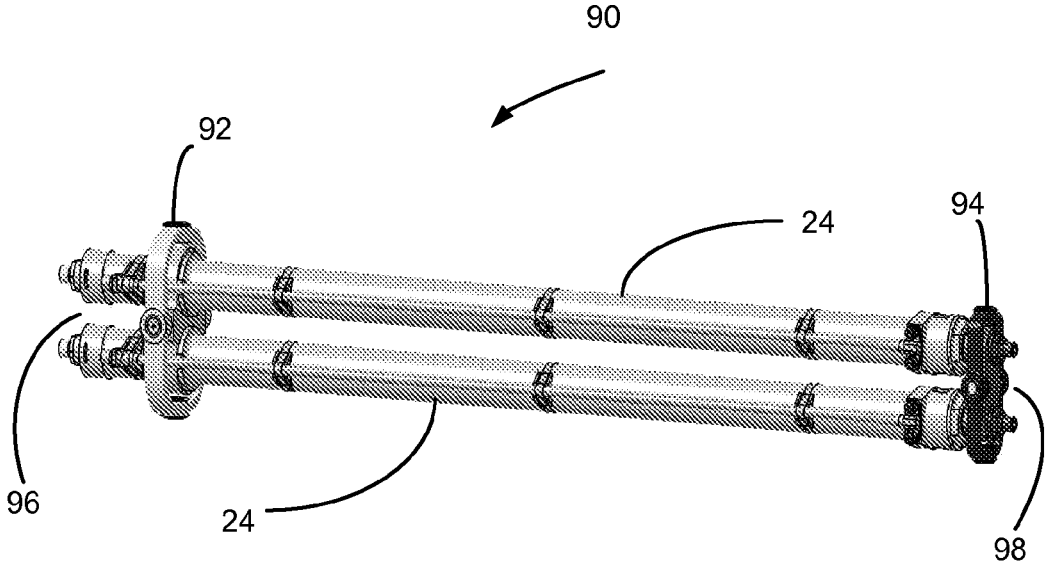
FIG. 7 is perspective view of exemplary telescoping fluid porting tubes of the electro-hydraulic system.
Figure 8:
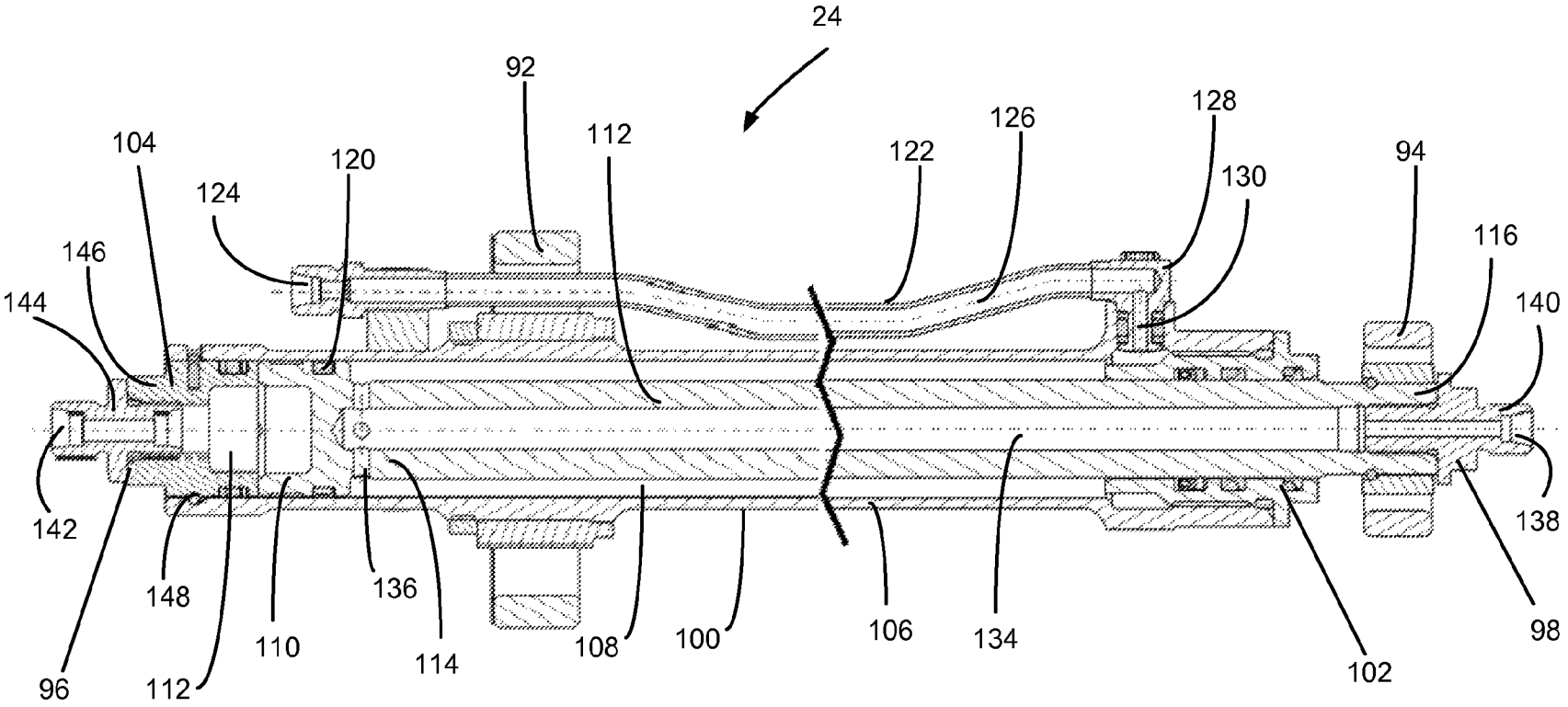
FIG. 8 is a cross-sectional view of one of the telescoping fluid porting tubes of FIG. 7.

Turning now to FIGS. 7 and 8, the telescoping fluid porting tube 24 enables porting of fluid, such as hydraulic fluid, between stationary and moveable structures of the engine 12. Particularly, the transcowl 16 may be moveable relative to the engine base structure 14 between a stowed position and an active position. Thus, during movement of the transcowl 16, telescopic movement of components of the telescoping fluid porting tube 24 may enable porting of fluid between components of the electro-hydraulic control system 10 that are connected to the engine base structure 14, transcowl 16, and VAFN structure 18. Additionally, when the transcowl 16 is in a stowed position, telescoping components of the telescoping fluid porting tube 24 are bottomed internally.

FIG. 7 illustrates a pair of telescoping fluid porting tubes 24, referred to herein as a porting tube assembly 90, configured to be mounted between the engine base structure 14 and the transcowl 16. One of the telescoping fluid porting tubes 24 may be fluidically connected to the VAFN actuator 26, such as to the extend chamber 44 of the VAFN actuator, to provide fluid to the actuator for effecting extension of the VAFN structure 18. The other telescoping fluid porting tube 24 may be fluidically connected to the other VAFN actuator 26, such as to the retract chamber 46 of the VAFN actuator 26, to provide fluid to the actuator for effecting retraction of the VAFN structure 18. The telescoping fluid porting tubes of the porting tube assembly 90 may be mounted parallel to one another, which may be effected via gimballing mount 92 on a head end 96 and via gimballing mount 94 on the a rod end 98 of the telescoping fluid porting tube 24, respectively, for mounting the telescoping fluid porting tubes 24 to the engine base structure 14 and the transcowl 16 to accommodate for potential misalignment between the engine base structure 14 and the transcowl 16. For example, axial clearance may be built into the gimballing mounts 92, 94 so that the telescoping fluid porting tube 24 bottoms internally when the transcowl 16 is in a stowed position. Alternatively, it will be appreciated that the head end 96 may be mountable to the transcowl 16 and the rod end 98 may be mountable to the engine base structure 14.

The telescoping fluid porting tubes 24 include an outer tubular body 100 with an open end 102 at the rod end 98 and a closed end 104 at the head end 96. A tubular wall 106 of the outer tubular body 100 defines a chamber 108 opening to the open end 102. A piston 110 is axially disposed in and axially translatable within the chamber 108, and a telescopically moveable piston rod 112 has a first end 114 and a second end 116, where the first end 114 is connected to the piston 110. The second end 116 of the piston rod 112 may be mountable to one of the engine base structure 14 or the transcowl 16. The piston rod 112 extends at least partially through the open end 102 of the outer tubular body 100 and is radially inwardly spaced from the tubular wall 106 thereby defining a fluid flow passage between the tubular wall 106 and an outer wall of the piston rod 112. The piston 110 is sealed to an inner portion of the tubular wall 106 by a suitable seal, such as o-ring 120, to prevent fluidic communication between the closed end 104 and the fluid flow passage between the tubular wall 106 and the outer wall of the piston rod 112 when the piston 110 and piston rod 112 are axially translated or telescoped relative to the outer tubular body 100.

The telescoping fluid porting tube 24 also includes an extension tube 122 having a first end defining an extension port 124 configured to be fluidically coupled to the control valve 22. The extension tube 122 also includes a fluid passageway 126 that runs along a length of the tubular body 100 and a second end 128 that is sealed to an opening 130 in the tubular body 100. The second end 128 may be located proximate the open end 102 of the outer tubular body 100.

Fluid enters the extension tube 122 via the extension port 124, flows through the fluid passageway 126 and out the second end 128 and into the chamber 108. The fluid flows through the chamber 108 to the first end 114 of the piston rod 112 and enters a cavity of the piston rod that defines a fluid passageway 134 via one or more openings 136 in a wall of the piston rod 112. The fluid flows through the fluid passageway 134 along a length of the piston rod 112 to a port 138 in a plug 140 coupled to the second end 116 of the piston rod 112 in any suitable manner. The port 140 is fluidically coupled to the VAFN actuator 26 for delivering fluid from the fluid passageway 134 to the VAFN actuator 26.

The telescoping fluid porting tube 24 may also include a port 142 in a plug 144 coupled an end member 146 in any suitable manner, and the end member 146 may be coupled to the closed end 104 in any suitable manner, such as by a retainer wire 148. The port 142 fluidically couples a fluid line having return pressure of the engine 12 with a portion of the chamber 108 between the closed end 104 and the piston 110, which is sealed off from the rest of the chamber 108 by the o-ring 120. The ports 142 on each of the telescoping fluid porting tubes 24 may be fluidically connected. The system may provide equal pressure on each side of the piston 110, which allows for unrestricted telescoping of the telescoping fluid porting tube 24 and unrestricted motion of the transcowl 16 without adding significant load to the transcowl 16 or the engine base structure 14.

Turning now to FIGS. 9-12, the control valve 22 for controlling the flow of fluid through the telescoping fluid porting tube 24 to the VAFN actuator 26 may be in direct fluidic communication with the supply line 28 and the telescoping fluid porting tube 24. The control valve 22 may include a system of components fluidically and communicatively connected. Such system of components may include a solenoid valve, needle valve, electro-hydraulic servo valve, spool valve, bypass valve, or other valve sufficient for controlling flow or pressure of a fluid such as a hydraulic fluid. As depicted, the control valve 22 may include a proportional valve, such as an electro-hydraulic servo valve (herein "EHSV") 160, and a bypass valve 162. The EHSV 160 is an electro-hydraulic device that converts an electrical signal into pressure and flow, and can be spring biased towards the open position of the associated VAFN structure 18 so that if a loss of command occurs, the VAFN structure 18 would open. The EHSV 160 may be a standard two-stage EHSV with a single feedback spring between first and second stages. It may have the properties of a long stroke spool, high chip shear forces, ability to pass large contaminants, and insensitivity to erosion. An integral electrical connector (not shown) may be used to connect to a controller 164 for controlling the control valve 22. The EHSV 160 may have dual coils and may be used for dual channel control from a central command center (not shown), such as a full authority digital engine control (FADEC) system, via the controller 164 communicatively connected to the central command center.

The bypass valve 162 may include a housing defining a spool chamber. A spool of the bypass valve 162 may be axially moveable in one direction into a default position by a helical compression spring of the bypass valve 162. The default position may allow fluidic communication between the control valve 22 and the VAFN actuator 26. The spool may also be moveable in the other direction into a secondary position by pressure of a fluid in communication with the bypass valve 162. The secondary position of the bypass valve 162 may enable fluidic communication between a plurality of valve ports of the bypass valve 162 and the plurality of ports 138, 142 of the telescoping fluid porting tube 24. Concurrently, the secondary position may also prohibit fluidic communication between the control valve 22 and the VAFN actuator 26. A screened restrictor may also be located in a hydraulic fitting of a fluid line coupled to the bypass valve 162. The purpose of this restrictor is to dampen the pressure of fluid in communication with the bypass valve 162 and to restrict pressure from the control valve 22 should a seal failure occur in a sleeve of the bypass valve 162.

Figure 9:
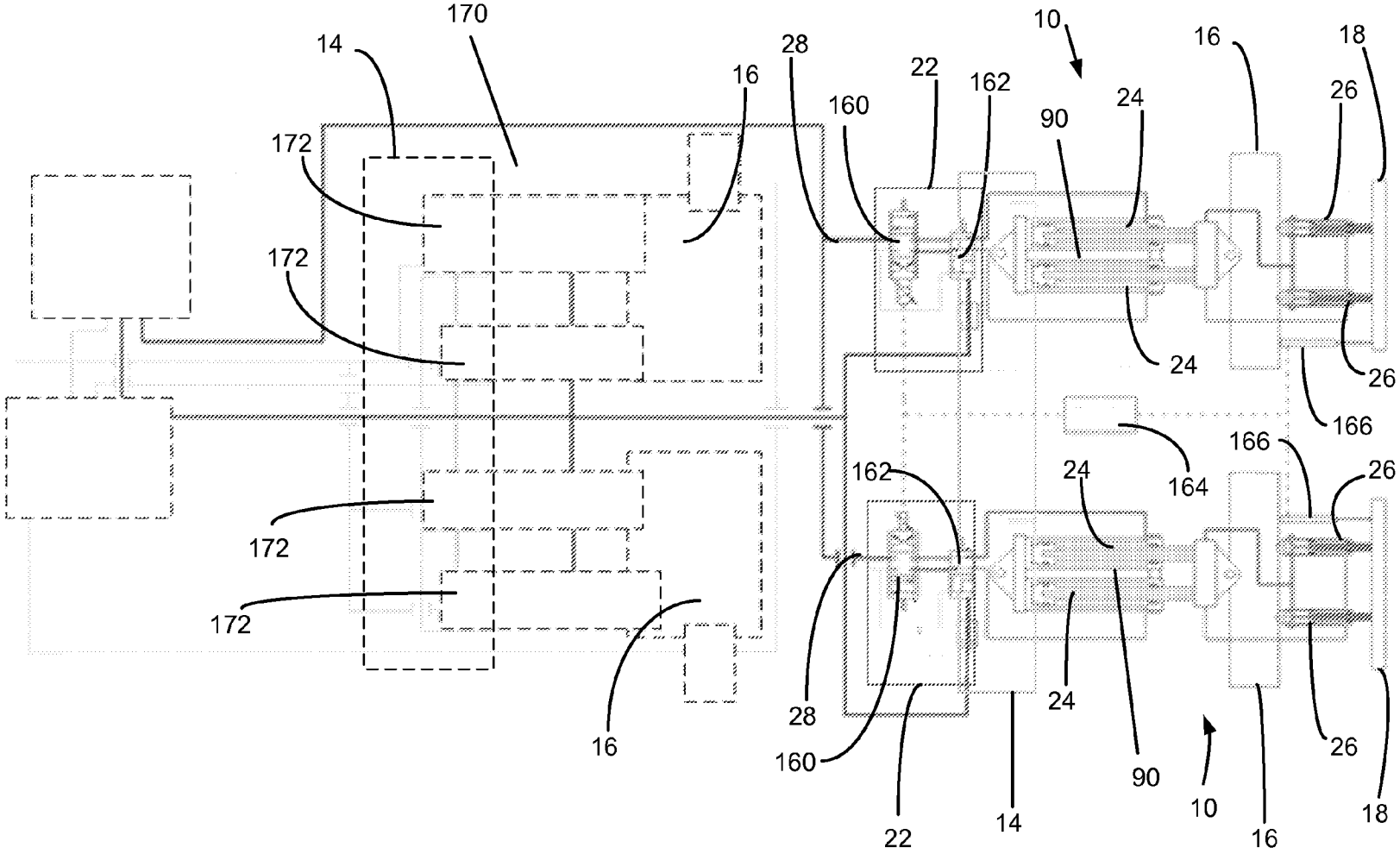
FIG. 9 is a schematic view of the engine having the exemplary electro-hydraulic control system and a thrust reverser actuation system.
Figure 10:
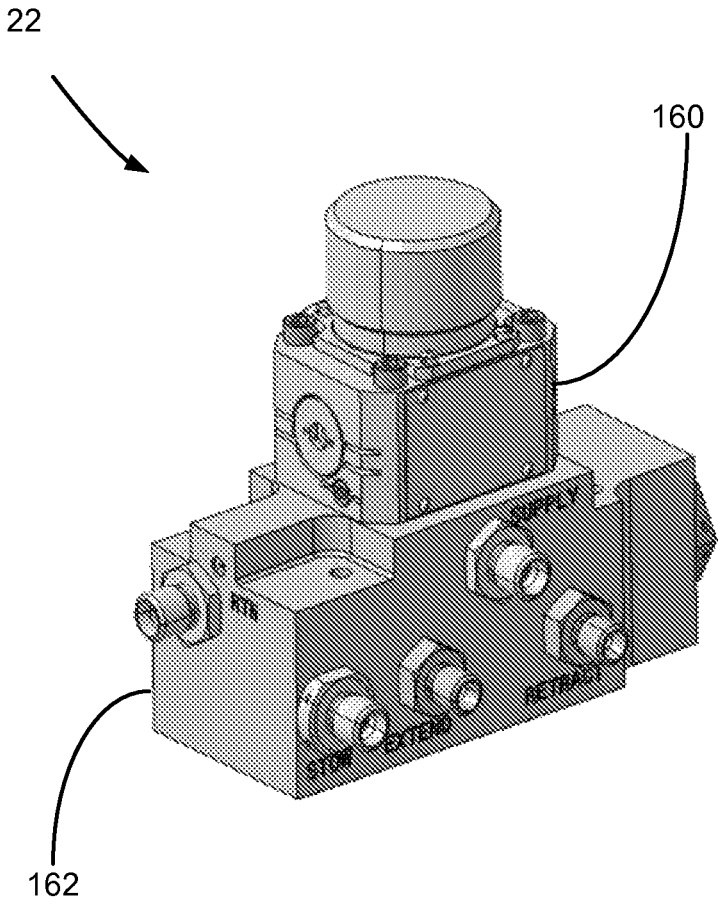
FIG. 10 is a perspective view of an exemplary control valve of FIG. 9.
Figure 11:
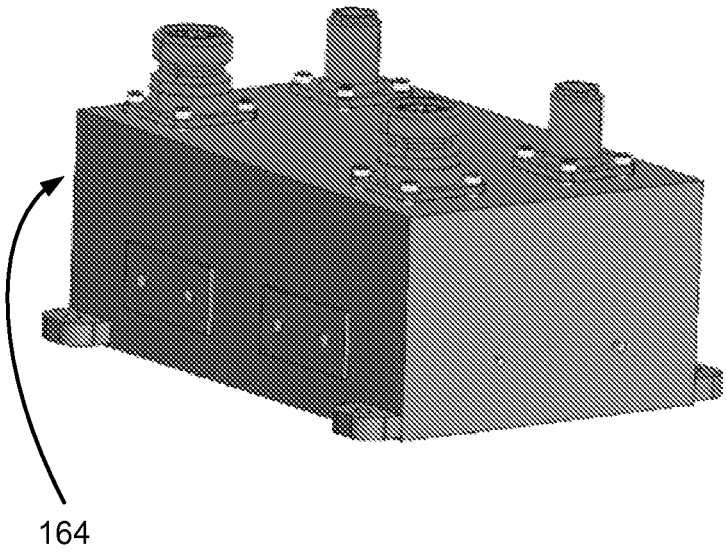
FIG. 11 is a perspective view of an exemplary controller of FIG. 9.
Figure 12:
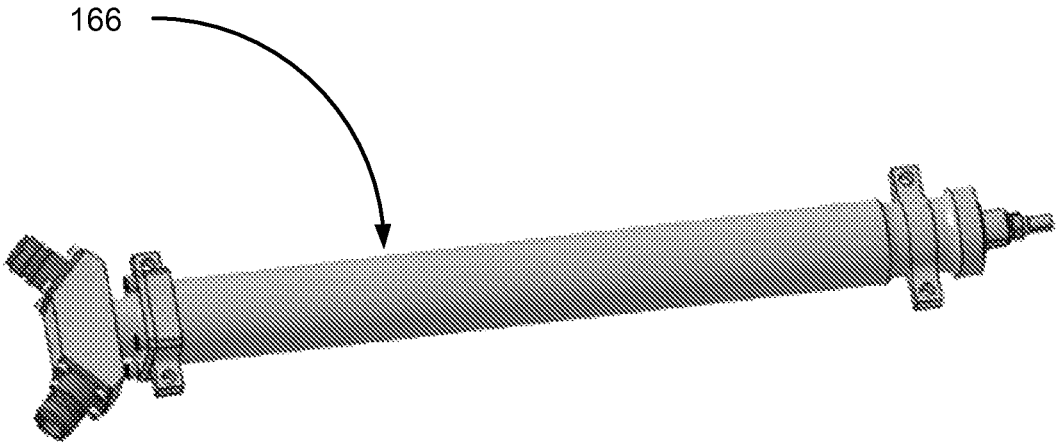
FIG. 12 is a perspective view of an exemplary linear variable differential transducer of FIG. 9.

The control valve 22, controllable by the controller 164, may provide selective control of extension and retraction of the VAFN structure 18 relative to at least one of the engine base structure 14 or the transcowl 16 and also selective control of flow area between more than one VAFN structure 18. The controller 164 may be communicatively connected to the control valve 22 of each of the left and right electro-hydraulic control systems 10. Accordingly, the controller 164 may be configured to send a response to the control valve 22 and to receive feedback from a feedback apparatus. The feedback apparatus, such as a linear variable differential transducer (herein "LVDT") 166, may be mountable to at least one of the engine base structure 14, the transcowl 16, or the VAFN structure 18, such as between the engine base structure 14 and the VAFN structure 18 (FIG. 2), or between the transcowl 16 and the VAFN structure 18 (FIG. 9). The LVDT 166 may include a probe core moving element that is spring-loaded towards being extended and also mountable to the VAFN structure 18. Alternatively, the probe core moving element may be located for physical contact with the VAFN structure 18 but not for mounting with the VAFN structure 18. Thus, when connected to or contacting the VAFN structure 18, the LVDT 166 may send feedback to the controller 164 regarding positioning of the VAFN structure 18 and also regarding loading effect of air flow and air pressure on the VAFN structure 18.

As shown in FIG. 9, the electro-hydraulic control system 10 is operable in conjunction with a thrust reverser actuator system (herein "TRAS") 170. The TRAS 170 may contain a thrust reverser actuator 172 mountable between the engine base structure 14 and the transcowl 16 for effecting movement of the transcowl 16 relative to the engine base structure 14. Specifically, the electro-hydraulic control system 10 may operate differently according to each of two operating modes of the turbine engine, a bypass mode and an active mode. When the transcowl 16 is active and not stowed via the TRAS 170, the electro-hydraulic control system 10 is in the bypass mode. Alternatively, when the transcowl 16 is stowed and isolated via the TRAS 170, the electro-hydraulic control system 10 is in the active mode.

When the transcowl 16 is stowed via the TRAS 170, the electro-hydraulic control system 10 is in the active mode. Stow pressure of the thrust reverser actuators 172 will be equal to the return pressure of the engine 12. Stow pressure working on the spool of the bypass valve 162 is overcome by the spring load on the opposite end of the spool, thus moving the spool to the default position. In the default position, pressure from the EHSV 160 is routed to the VAFN actuators 26 through the porting tube assembly 90. Fluid flow and pressure is ported through the porting tube assembly 90 to the VAFN actuators 26. As noted above, a first telescoping fluid porting tube 24 ports extend pressure and a second telescoping fluid porting tube 24 ports retract pressure. Regarding each telescoping fluid porting tube 24, the piston 110 and piston rod 112 are fully retracted and bottom internally in the chamber 108.

As noted above, the controller 164, communicatively connected to the EHSV 160 and the LVDT 166, controls the position of the VAFN actuators 26 and allows the VAFN structure 18 to move to any commanded position. The VAFN actuators 26 may be mechanically synchronized to precisely position the VAFN structure 18. The VAFN structure 18 of the left electro-hydraulic control system 10 and the VAFN structure 18 of the right electro-hydraulic control system 10 may be electronically synchronized by the controller 164 via communicative connection with the EHSV 160 and the LVDT 166 associated with each VAFN structure 18. In an aircraft, for example, each VAFN structure 18 could be expected to have slightly different loads affecting it during flight. The VAFN structure 18 of the left electro-hydraulic control system 10 could have higher loads than the VAFN structure 18 of the right electro-hydraulic control system 10. Because each VAFN structure 18 is controlled by its own associated EHSV 130, the EHSV 130 will provide a proportional signal to match the loads and velocity needed by each VAFN structure 18.

When the transcowl 16 is not stowed via the TRAS 170, the electro-hydraulic control system 10 will be in the bypass mode. Stow pressure of the thrust reverser actuators 172 will be equal to the supply pressure of the engine 12. Stow pressure working on the spool of the bypass valve 162 moves the spool to the secondary position or bypass position. Thus, as noted above, the ports 138, 142 of the telescoping fluid porting tube 24 are connected to a fluid line at return pressure while the bypass valve 162 is in the secondary position. When the thrust reverser actuators 172 move the transcowl 16, a volume of fluid stored inside each telescoping fluid porting tube 24 must change. Such change is effected via the bypass valve 162. As noted above, providing for return pressure at the ports 138, 142 of the telescoping fluid porting tube 24, thus providing for equal pressure on each side of the piston 110, allows for unrestricted telescoping of the telescoping fluid porting tube 24 and unrestricted motion of the transcowl 16 without adding significant load to the transcowl 16 or the engine base structure 14. Consequently, because the ports 138, 142 of the telescoping fluid porting tube 24 are also fluidically connected, pressure is equal at each of the extend and retract chambers 44, 46 of the VAFN actuator 26. Thus, the pressure is equal on each side of the piston 38 of the VAFN actuator 26, and the VAFN actuator 26 is unable to provide output force to the VAFN structure 18 as the transcowl 16 is moved.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An engine comprising:

a mechanical assembly comprising a first structure, a second structure and a third structure, wherein the first structure is an engine base structure, the second structure is a transcowl, and the third structure is a variable area fan nozzle structure;

an electro-hydraulic control system including:

a power actuator mountable between the second structure and the third structure, the power actuator for moving the third structure, a telescoping fluid porting tube mountable between the first structure and the second structure for porting a fluid to the power actuator, and a control valve for controlling flow of the fluid through the telescoping fluid porting tube to the power actuator for effecting movement of the third structure, wherein the telescoping fluid porting tube has an outer tubular body having a proximal end for mounting to one of the first structure or the second structure, a distal end opposite the proximal end, and a tubular wall defining a chamber, a piston axially disposed in and axially translatable within the chamber and having oppositely disposed proximal and distal sides, and a telescopically movable piston rod having a first end connected to the distal side of the piston and a second end mountable to the other of the first structure or the second structure, the piston rod extending at least partially through the distal end of the outer tubular body and being radially inwardly spaced form the tubular wall, and the piston rod having a fluid passageway in fluidic communication with the chamber, the fluid passageway transferring fluid along a length of the piston rod, wherein the proximal side of the piston is isolated from any flow through the fluid passageway in the piston rod.

2. The engine of claim 1, wherein the proximal end of the outer tubular body is open to an environment external to the electro-hydraulic control system.

3. The engine of claim 1, wherein the outer tubular body has a port fluidically coupled to the control valve for receiving fluid therefrom.

4. The engine of claim 3, wherein the port extends through the tubular wall of the outer tubular body.

5. The engine of claim 3, wherein the port is adjacent to the open end of the outer tubular body.

6. The engine of claim 1, wherein the piston of the electro-hydraulic control system is sealed to an inner portion of the tubular wall to prevent fluidic communication between the proximal end and the fluid passageway when the piston is axially translated.

7. The engine of claim 1, wherein the piston rod of the electro-hydraulic control system includes at least one opening at the first end extending through a wall of the piston rod for fluidically coupling the chamber to the fluid passageway.

8. The engine of claim 1, wherein the telescoping fluid porting tube is mountable to at least one of the first structure or the second structure via a gimballing mount.

9. The engine of claim 1, wherein the telescoping fluid porting tube is a first telescoping fluid porting tube and further including a second telescoping fluid porting tube mounted in tandem with the first telescoping fluid porting tube and mountable between the first structure and the second structure.

10. The engine of claim 9, wherein the first telescoping fluid porting tube has a first fluid path extending along the fluid passageway of the piston rod and between the control valve and the power actuator for porting fluid for effecting movement of the third structure away from the first structure, and the second telescoping fluid porting tube has a second fluid path extending between the control valve and the power actuator for porting fluid for effecting movement of the third structure towards the first structure.

11. The engine of claim 9, wherein the first and second telescoping fluid porting tubes are aligned parallel to one another.

12. The engine of claim 1, further including a pair of power actuators for effecting movement of the third structure relative to at least one of the first structure or the second structure.

13. The engine of claim 1, further including a control system for regulating a fluid pressure at the power actuator, the control system communicatively connected to both the control valve and to a feedback apparatus mountable to the third structure or locatable to contact the third structure.

* * * * *